United States Patent [19]

Brooks, Jr.

[11] Patent Number: 4,713,916

[45] Date of Patent: Dec. 22, 1987

[54] CEILING DOME

[75] Inventor: Raymond E. Brooks, Jr., Largo, Fla.

[73] Assignee: Hardwood Lighting Designs Corp., Largo, Fla.

[21] Appl. No.: 924,950

[22] Filed: Oct. 8, 1986

[51] Int. Cl.[4] ..... G09F 7/18

[52] U.S. Cl. ..... 52/39; 52/28; 362/147; 362/364

[58] Field of Search ..... 52/39, 28; 362/147, 362/148, 150, 364, 367

[56] References Cited

U.S. PATENT DOCUMENTS

| | | | |
|---|---|---|---|
| 3,372,270 | 3/1968 | Quin et al. | 362/150 |
| 3,755,667 | 8/1973 | Price | 362/147 |
| 3,786,602 | 1/1974 | Wilkin | 362/150 X |
| 4,001,985 | 1/1977 | Nikolaus et al. | 52/28 |
| 4,356,540 | 10/1982 | Goralnik | 362/148 X |

*Primary Examiner*—Carl D. Friedman

*Attorney, Agent, or Firm*—Herbert W. Larson; Joseph C. Mason, Jr.

[57] ABSTRACT

A ceiling dome having a top frame and bottom frame connected together by an arched linking bracket. The top and bottom frame contain slotted tracks for receiving luminescent panels and decorative strips. The dome can be manufactured in a factory and installed at a work site in minutes by affixing integral dome supports to the inside surface of a soffit containing electrical light fixtures.

15 Claims, 7 Drawing Figures

CEILING DOME

DESCRIPTION

1. Technical Field

This invention relates to a ceiling dome. More specifically, it refers to a light diffusing ceiling dome fixture capable of being factory manufactured and installed intact on site.

2. Background Art

Many devices and methods are known for diffusing light, particularly the light from fluorescent fixtures. The most common device is the dropped ceiling. Lighting fixtures are mounted flush with the ceiling and then suspended from the ceiling are grids made up of T-mouldings. Ceiling panels, vents or light diffusing panels are supported by the grids. Another method is to suspend diffuser panels by brackets from a light fixture as described in U.S. Pat. No. 4,263,639. Still another method is to construct a ceiling dome on site within a soffit. Such domes have a top frame and a bottom frame nailed to the inside of the soffit with diffuser panels mounted between them. Whereas all the above methods work to diffuse light, they require considerable installation work on site and this increases labor costs. A light diffusing dome is needed which can be manufactured in a factory, shipped to a building site and installed with a minimum involvement of on site labor.

SUMMARY OF THE INVENTION

I have invented a ceiling dome that can be factory manufactured and readily installed in a prepared ceiling soffit. Installation is completed within a few minutes using only a power driven screw driver.

My ceiling dome comprises a top frame and a bottom frame, each containing slotted tracks for receiving four luminescent panels. Multiple frame supports are affixed to the bottom frame for nailing or screwing into a ceiling soffit. The dome has a linking member at each corner connecting the top and bottom frames. The luminescent panels are snapped into the slotted tracks as soon as the dome is affixed to the soffit. Decorative strips can also be snapped into the slotted tracks, and an overlapping flange on the bottom frame adds style to the dome.

BRIEF DESCRIPTION OF THE DRAWINGS

The present invention may be best understood by those of ordinary skill in the art by reference to the following detailed description when considered in conjunction with the accompanying drawings in which.

DESCRIPTION OF THE PREFERRED EMBODIMENT

Figure 1:
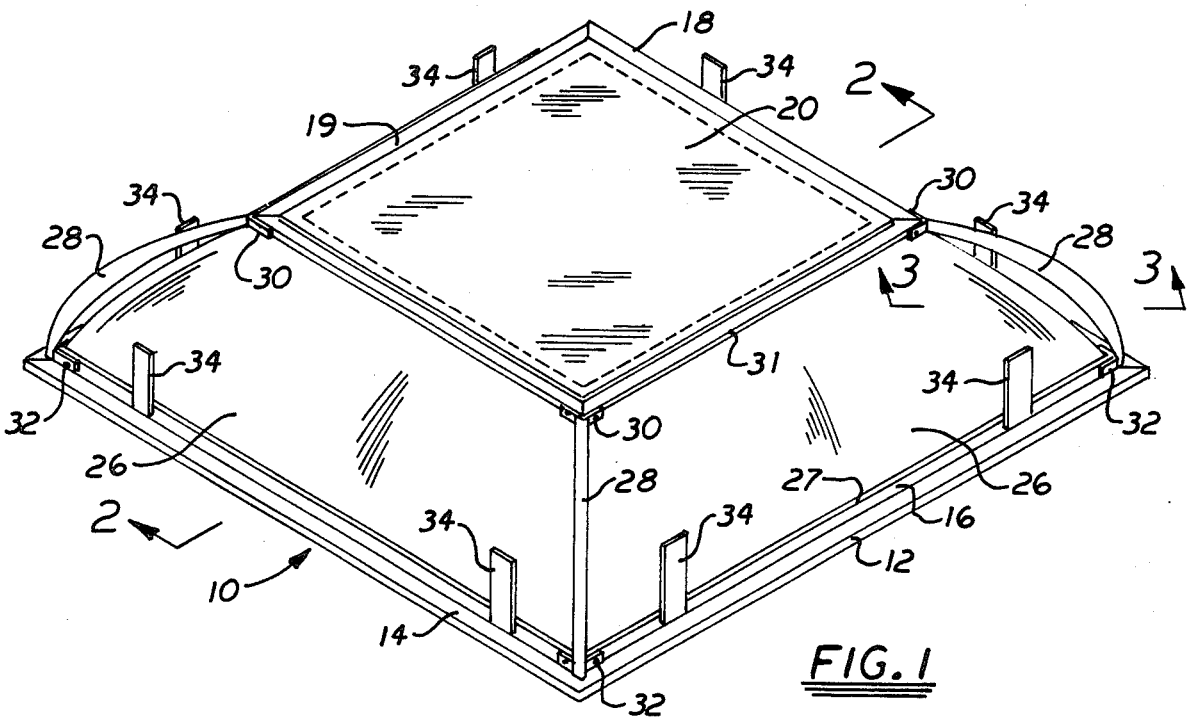
FIG. 1 is a perspective view of the ceiling dome ready for installation .
Figure 2:
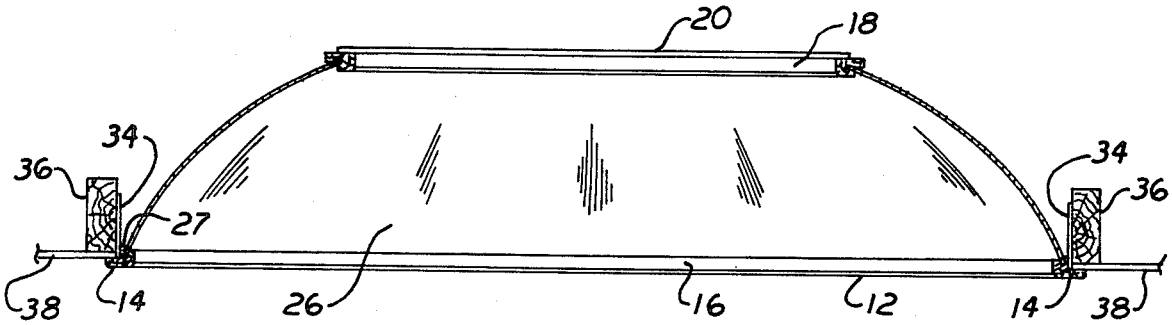
FIG. 2 is a cross section elevation view of an installed ceiling dome along line 2—2 of FIG. 1.

Referring now to the drawings in which like reference characters designate like or corresponding parts throughout the several views, there is shown in FIG. 1 the factory manufactured ceiling dome 10.

The ceiling dome 10 has as component parts a bottom frame 12 and a top frame 18. The bottom frame 12 has an outwardly projecting flange 14 and an upright lip 16. The top frame 18 has a planar shelf 19 sufficiently wide to support a top member 20.

Figure 4:
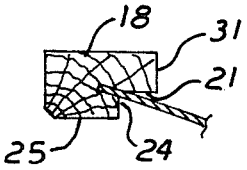
FIG. 4 is a cross section view through the top frame showing the position of the luminescent panel in the top frame slotted track.
Figure 3:
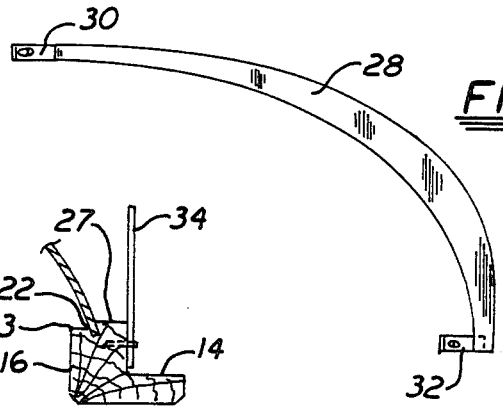
FIG. 3 is an elevation view of one of the four linking members along line 3—3 of FIG. 1.
Figure 5:
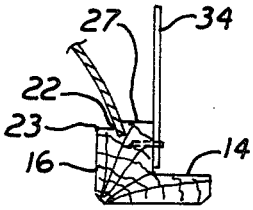
FIG. 5 is a cross section view through the bottom frame showing the position of the luminescent panel in the bottom frame slotted track.

The bottom frame 12 has a shallow notched portion 23 at the top surface 27 of lip 16 in which slotted track 22 is located. See FIG. 5. The top frame 18 also has a notched portion 21 but along its lower surface 25 with a slot 24 intersecting the interior apex of notch 21. See FIG. 4. A luminescent panel 26 is inserted on its lower edge into slot 22 and along its upper edge into slot 24 for firm seating within the ceiling dome 10.

Linking member 28 is an arched element joining bottom frame 12 and top frame 18. Each end of linking member 28 has an L-shaped or right angled bracket 30 or 32. L-shaped bracket 30 is screwed to the side 31 at a corner of top frame 18 and L-shaped bracket 32 is screwed to the corner of the upright lip 16 in the bottom frame support 12. Each side 31 of top frame 18 is mitered to the adjacent side 31 to form a corner around which the L-shaped bracket 30 is placed. In like manner, each lip 16 of the bottom frame is mitered to the adjacent lip 16 to form a corner around which the L-shaped bracket 32 is placed. The linking member 28 can be made of wood or aluminum. However, it is preferred that the linking member be made of aluminum and that each of the L-shaped brackets be brazed to the aluminum. The inner enclosure of each L-shaped bracket faces the same direction as the concave portion of linking member 28. There are four linking members 28 each one attached to a corner of the ceiling dome 10.

Multiple dome supports 34 are screwed to the outside surface or side of upright member 16 in the bottom frame 12. These dome supports preferably can be made of aluminum painted white so that they cannot be viewed from the underside of the dome. The dome supports are screwed to a wood member 36 within the soffit.

The ceiling dome 10 is designed in such a way that the flange 14 in bottom frame 12 extends over the hole of the soffit and, therefore, overlaps ceiling 38. In this manner, slight errors in the construction of the soffit opening is compensated for by the flange 14 being about ½" wider than necessary to accommodate such errors.

The ceiling dome 10 lends itself to manufacture in a factory because linking members 28 provide sufficient rigidity to dome 10 to withstand shipment to the work site. The ceiling dome 10 is easily screwed to the available soffit after installation of the desired lighting which is usually fluorescent. After the frame of ceiling dome 10 is installed, the luminescent panels 26 are snapped into the slotted tracks 24 and 22 respectively to complete the installation.

The top member 20 is usually made of three-ply mahogany plywood covered with a white vinyl so that it blends in with the ceiling and provides a pleasant affect to the viewer below.

Figure 6:
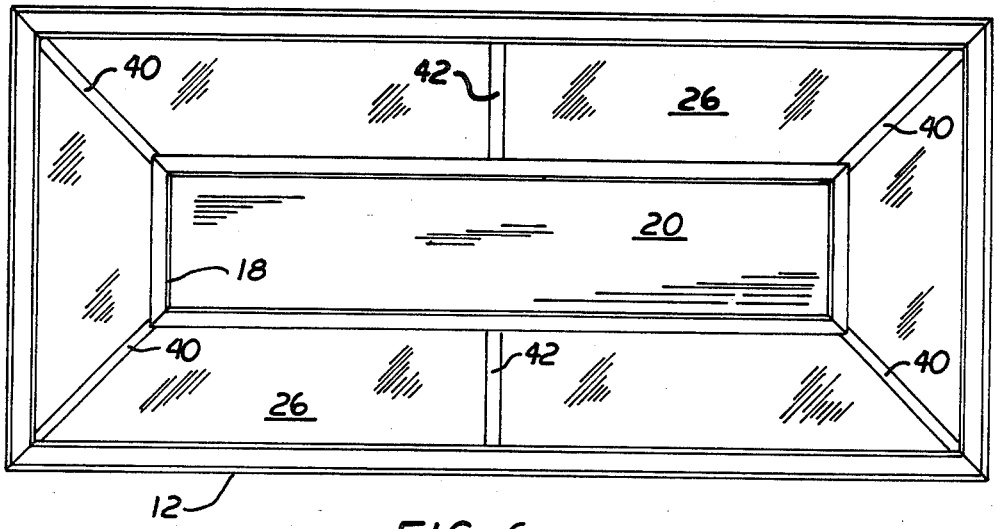
FIG. 6 is a bottom view looking upward from the floor of a room having a ceiling dome installed.

Optionally, decorative strips 40 can be inserted into the tracks 22 and 24 respectively at the juncture of each luminescent panel 26 and additional decorative strips 42 can be added as desired merely by snapping into the respective slotted tracks 22 and 24. Such decorative strips are shown in FIG. 6.

Figure 7:
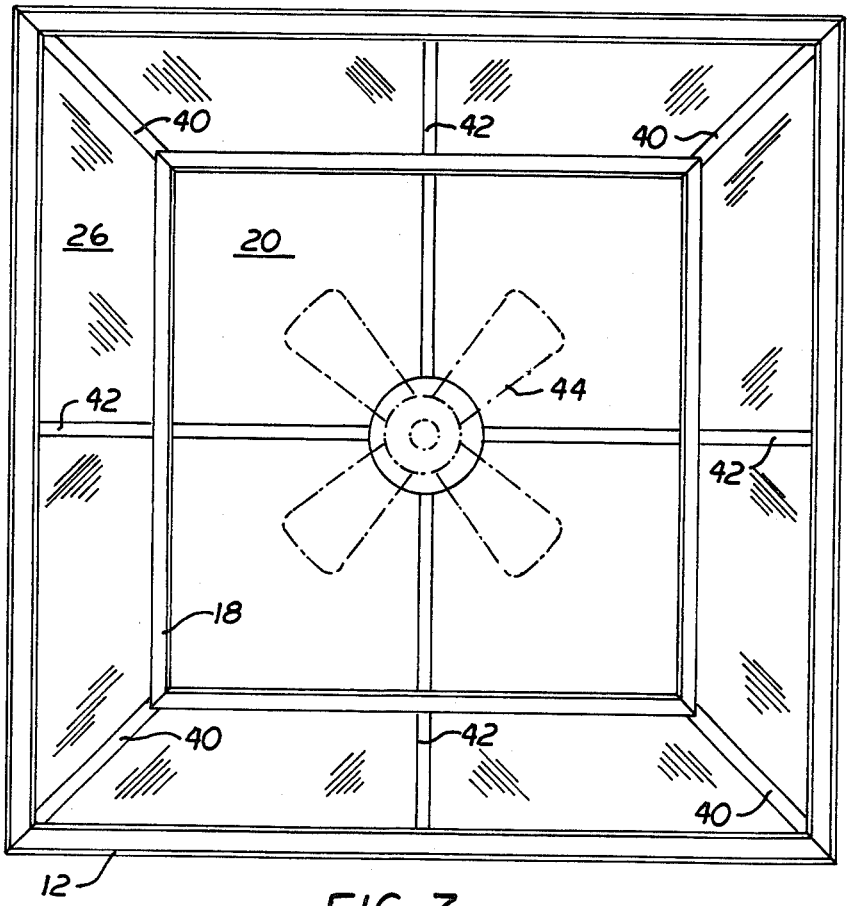
FIG. 7 is a bottom view looking upward from the floor of a room having a ceiling fan installed within a dome.

As a further option, a ceiling fan 44 can be mounted within the dome merely by making a hole in the top member 20 to allow for passage of the fan shaft to its electrical source and its support in the upper portion of the soffit. Such a fan is shown in FIG. 7.

The top 18 and bottom 12 frames can assume various geometric shapes. However, they will generally be either square or rectangular. The frames are usually made of a hardwood such as oak, but the type of wood can vary depending on the design of the customer.

The panels 26 will usually be made of a plastic material suitable for light transmission. Usually the panel will be luminescent and will act to diffuse the light from the fixtures within the soffit.

Minor modifications and changes in the described ceiling dome can be made without departing from the invention as described herein.

Having thus described the invention what is claimed as new and desired to be secured by a Letters Patent is:

1. A factory manufactured ceiling dome for diffusing light comprising:

a. a top frame having a planar shelf for receiving a top panel on an upper surface and a notch on a bottom surface of the planar shelf with a first slotted track in the notch;

b. a bottom frame having an outwardly projecting flange for overlapping a ceiling and an upwardly projecting lip with a notch in a top surface containing a second slotted track;

c. four arched linking members each having a bracket at a first and second end, the bracket at the first end attached to the top frame and the bracket at the second end attached to the bottom frame; and d. light diffusing panels with an upper edge in the first slotted track and a lower edge in the second slotted track.

2. The ceiling dome according to claim 1 wherein multiple supporting members are attached to an outward side of the bottom frame lip.

3. The ceiling dome according to claim 2 wherein there are four lips forming four sides to the bottom frame and there are at least two supporting members attached to each side.

4. The ceiling dome according to claim 3 wherein the supporting members are aluminum.

5. The ceiling dome according to claim 2 wherein a ceiling fan is mounted to a ceiling support through a hole in the center of the top panel.

6. The ceiling dome according to claim 1 wherein the brackets are right angled and each enclose a corner of the top frame or bottom frame.

7. A ceiling dome comprising:

a. a top frame having four side members mitered together to form a geometric pattern and a notch on a bottom surface of each side member containing a first slotted track;

b. a bottom frame having four side members mitered together to form a geometric pattern of greater diameter than the top frame and a notch in a top surface of each side member containing a second slotted track;

c. multiple arched linking members, each having an attaching bracket at a first and second end, the bracket at the first end attached to the top frame and the bracket at the second end attached to the bottom frame; and d. light transmitting panels with an upper edge in the first slotted track and a lower edge in the second slotted track.

8. A ceiling dome according to claim 7 wherein the brackets are attached to the top and bottom frame at the mitered juncture of two side members.

9. A ceiling dome according to claim 7 wherein the top frame supports a top panel.

10. A ceiling dome according to claim 7 wherein the geometric pattern is a square.

11. A ceiling dome according to claim 7 wherein the geometric pattern is a rectangle.

12. A ceiling dome according to claim 11 wherein a ceiling fan is suspended through an interior area of the dome.

13. A ceiling dome according to claim 7 wherein the light transmitting panels are light diffusers.

14. A ceiling dome according to claim 7 wherein the arched linking member is aluminum.

15. A ceiling dome according to claim 14 wherein the brackets are brazed on the ends of each linking member.

* * * * *